United States Patent [19]

Jarman

[11] 4,304,215

[45] Dec. 8, 1981

[54] FIREPLACE HEATING UNIT

[76] Inventor: Charles P. Jarman, 221 H St., NW., Auburn, Wash. 98002

[21] Appl. No.: 963,100

[22] Filed: Nov. 22, 1978

[51] Int. Cl.[3] ..... F24B 7/00

[52] U.S. Cl. ..... 126/121

[58] Field of Search ..... 126/120, 121, 131, 61, 126/63, 66; 237/51

[56] References Cited

U.S. PATENT DOCUMENTS

| | | | |
|---|---|---|---|
| 3,952,721 | 4/1976 | Patterson | 126/63 |
| 4,003,362 | 1/1977 | Lener | 126/121 |
| 4,015,579 | 4/1977 | Wirth et al. | 126/63 |
| 4,074,679 | 2/1978 | Jensen | 126/121 |
| 4,089,320 | 5/1978 | Brown et al. | 126/121 |
| 4,170,219 | 10/1979 | Hansen et al. | 126/121 |

*Primary Examiner*—Samuel Scott

*Assistant Examiner*—Lee E. Barrett

*Attorney, Agent, or Firm*—Brady, O'Boyle & Gates

[57] ABSTRACT

A fireplace heating unit having a stainless steel firebox mounted within a double-walled housing, the firebox and housing being constructed and arranged to provide an inner air chamber communicating with outside air; and an outer air chamber communicating with the interior of the room being heated. The outside air is heated by the walls of the firebox and a portion of the heated air is directed into the firebox to be used as combustion air, and the remainder of the heated outside air is directed into the room to be heated. An insulated wall is provided between the inner and outer air chambers to maintain the air in the inner chamber at an extremely high temperature so that the combustion air ignites the exhaust gases in the fireplace thereby eliminating smoke from issuing through the stack.

5 Claims, 5 Drawing Figures

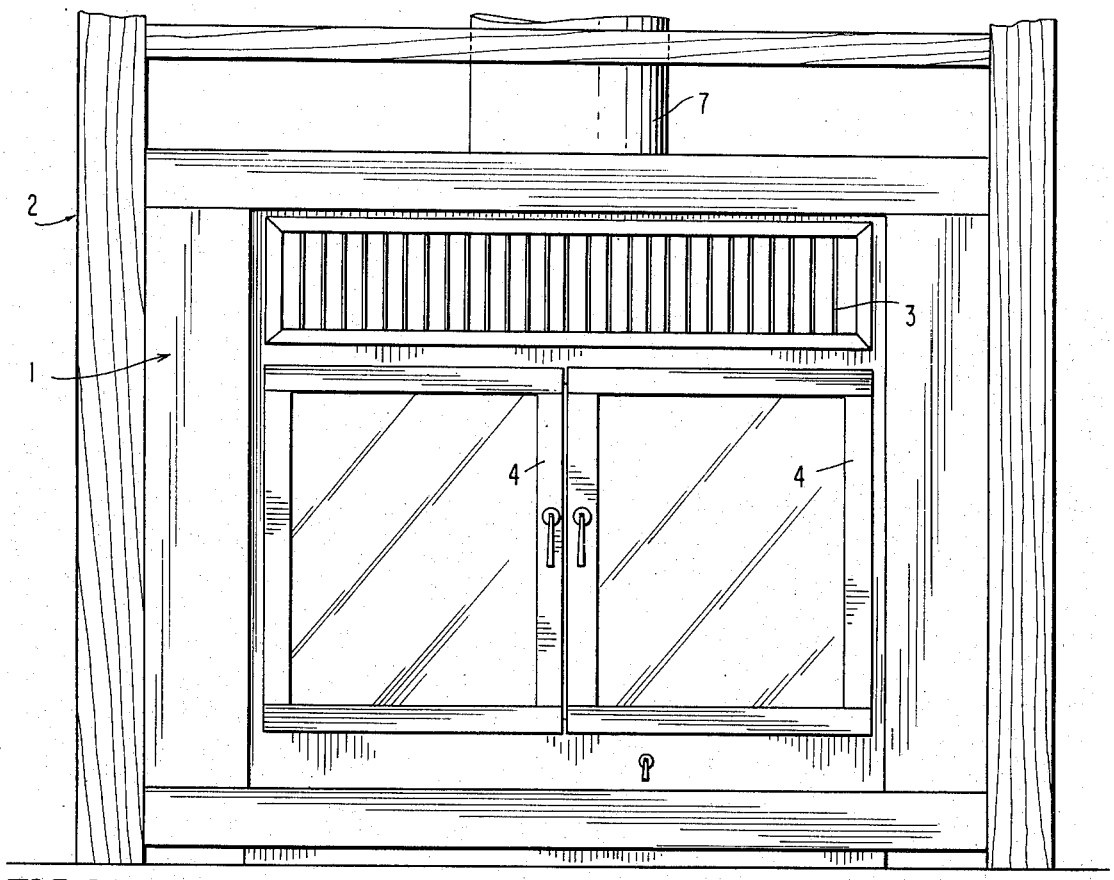
FIG. 1
FIG. 2
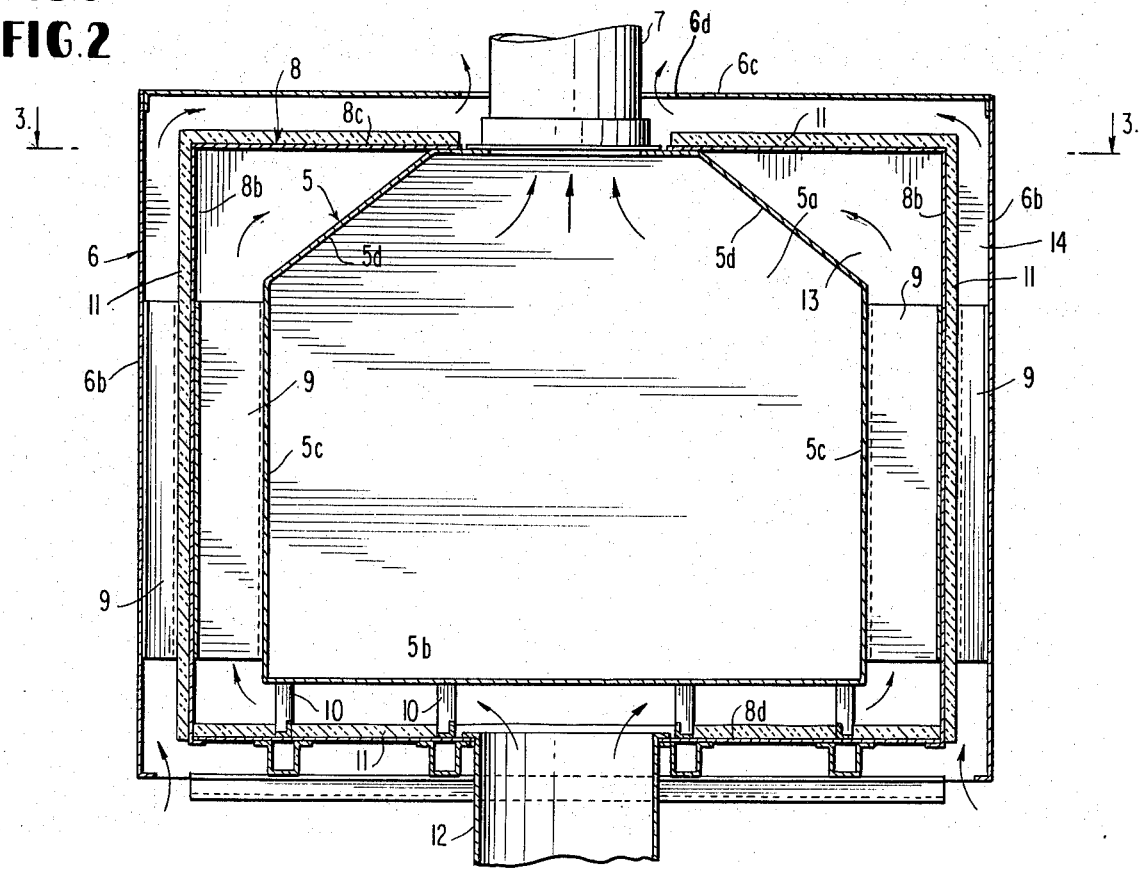

FIREPLACE HEATING UNIT

BACKGROUND OF THE INVENTION

Various types of home fireplaces have been proposed for installation in existing structures such as those disclosed in U.S. Pat. Nos. 4,059,090; 4,089,320; and 4,074,679. While these fireplace units have been satisfactory for their intended purpose, their inherent construction prevents these units from conforming to various federal, state and municipal ordinances governing the use of fireplace units in homes, particularly mobile homes. A few of these regulations require the use of outside air for use as combustion air, the elimination of a stack damper, the elimination of a combustion air front intake damper; also the elimination of the customary circulation of room air into the firebox combustion chamber which creates a negative air pressure inside the sealed mobile home.

After considerable research and experimentation, the fireplace heating unit of the present invention has been devised to conform to all the various regulatory requirements while at the same time providing a heating unit which is durable, safe, economical and designed for fast and easy installation.

The fireplace heating unit of the present invention comprises, essentially, a stainless steel firebox mounted within a housing. An insulated wall or partition is positioned within the housing to define an inner air chamber between the outer surface of the firebox walls and the inner face of the partition; and an outer air chamber between the outer face of the partition and the inner face of the housing walls. Outside or ambient air communicates with the inner chamber to be heated by the walls of the firebox. A portion of the heated air is directed into the firebox through apertures provided in the firebox side walls, the remainder of the incoming heated air being directed into the room to be heated. The outer chamber communicates with the room air being circulated therethrough.

BRIEF DESCRIPTION OF THE DRAWINGS

FIG. 1 is a front elevational view of the fireplace of the present invention;

FIG. 2 is a front sectional view of the fireplace;

DESCRIPTION OF THE PREFERRED EMBODIMENT

Figure 3:
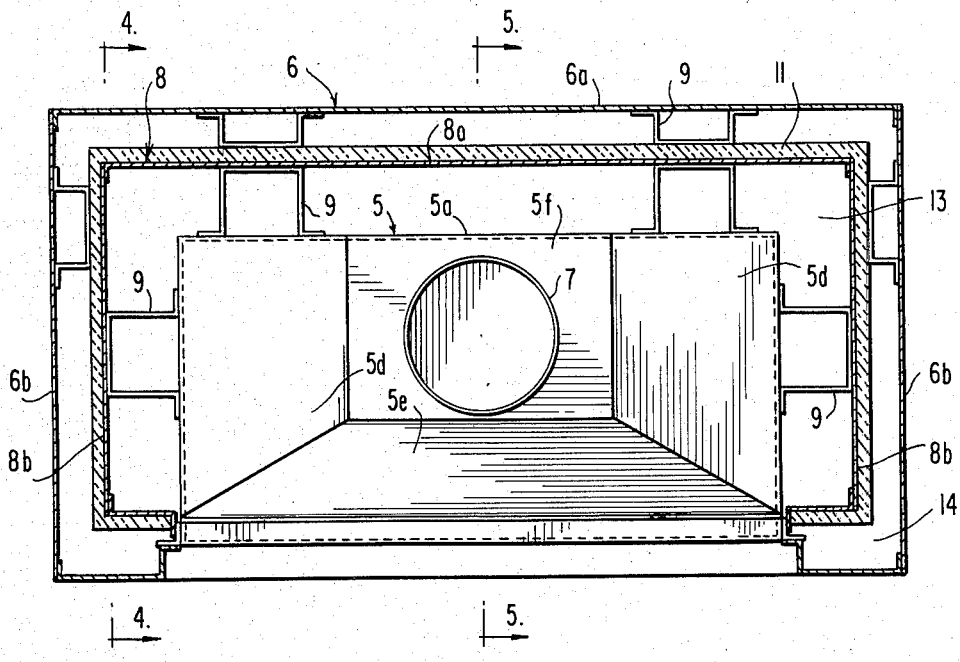
FIG. 3 is a view taken along line 3—3 of FIG. 2.

Referring to the drawings, and more particularly to FIG. 1 thereof, the fireplace unit 1 of the present invention is designed to be a "0" clearance type fireplace mounted within a wooden frame 2 to facilitate the installation thereof. The front of the fireplace includes an air louver or grill 3, and glass doors 4 closing the front of the firebox, to be described more fully hereinafter.

The details of the construction of the interior of the fireplace are shown in FIGS. 2 and 3 wherein it will be seen that a firebox 5 is mounted within a housing 6. The firebox includes a back wall 5*a*, a bottom wall 5*b*, straight side walls 5*c*, and truncated side and front walls 5*d* and 5*e*, respectively, the top wall 5*f* of the firebox being supported by the upper edges of the back wall 5*a*, and truncated side and front walls 5*d* and 5*e*, respectively. A suitable stack 7 is mounted on the top wall 5*f* and communicates with the interior of the firebox.

The housing 6 includes a back wall 6*a*, side walls 6*b* and a top wall 6*c*, the top wall having an enlarged aperture 6*d* through which the stack 7 extends.

A partition 8 is mounted within the housing 6 between the inner faces of the housing walls and the outer faces of the firebox walls, and includes a back wall 8*a*, side walls 8*b*, a top wall 8*c*, and a bottom wall 8*d*. The partition 8 is held in spaced relationship with respect to the side and back walls of the firebox 5 and housing 6 by suitable channel brackets 9, and the bottom wall 5*b* of the firebox is supported on the bottom wall 8*d* of the partition by angle legs 10. The outer faces of the side and top walls 8*b* and 8*c* of the partition are provided with a layer of insulation 11, and the inner face of the bottom wall 8*d* of the partition is similarly provided with an insulation layer; the bottom wall 8*d* of the partition also having an aperture to accommodate an air inlet duct 12 communicating with the atmosphere. As will be appreciated by those skilled in the art, the air inlet duct 12 could also include a fan, not shown.

By the construction and arrangement of the partition 8 between the firebox 5 and housing 6, an inner chamber 13 is provided between the outer faces of the firebox walls and the inner faces of the partition walls; and an outer chamber 14 is provided between the insulation layer 11 and the inner faces of the housing walls.

Figure 4:
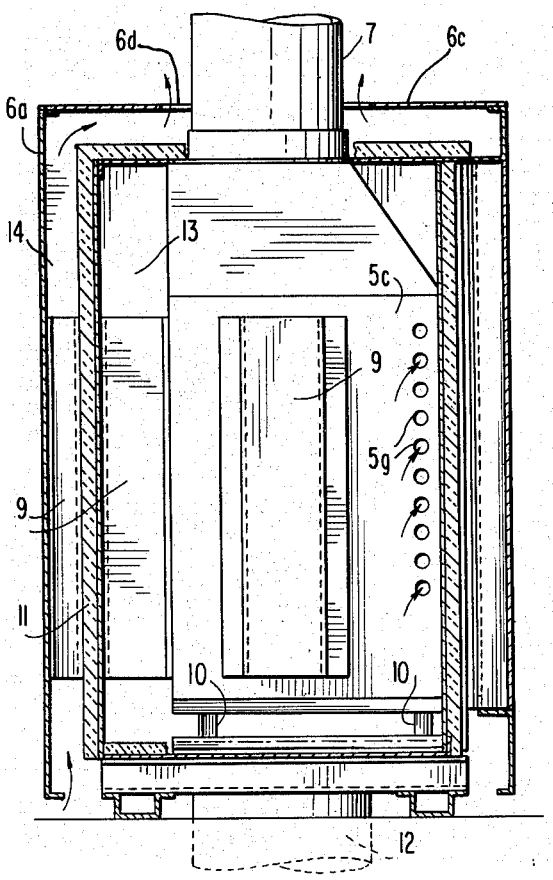
FIG. 4 is a view taken along line 4—4 of FIG. 3.
Figure 5:
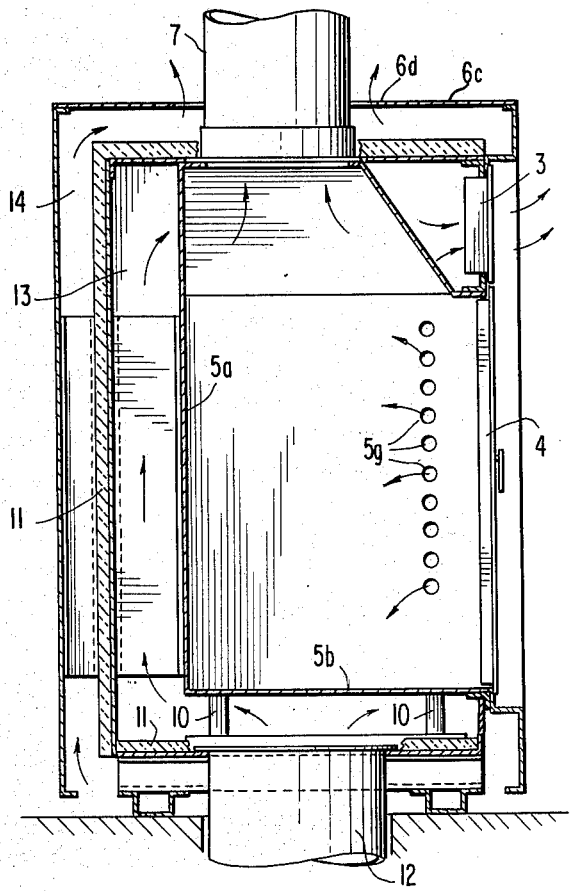
FIG. 5 is a view taken along line 5—5 of FIG. 3.

As will be seen in FIGS. 4 and 5, a plurality of vertically disposed apertures 5*g* are provided in the side walls 5*c* of the firebox adjacent the front thereof in proximity to the doors 4, whereby a portion of the incoming air is conducted to the firebox for use as combustion air.

In the operation of the fireplace heating unit of the present invention, as will be seen in FIGS. 4 and 5, incoming ambient air enters the inner chamber 13 from inlet air duct 12; the air circulates through the inner chamber while being heated by the walls of the firebox; a portion of the heated air enters the firebox 5 through apertures 5*g* and is used as combustion air; the remainder of the heated air exits through louver 3 and into the room to be heated. While the incoming air is being heated by the firebox, the room air is being circulated through the outer chamber 14 as shown by the arrows.

The firebox is constructed of stainless steel whereby the incoming air is raised to extremely high temperatures, in the order of 400° F., so that the portion of the incoming air, approximately ten percent, entering the firebox is at such a high temperature that the exhaust gases are ignited thereby eliminating smoke and other pollutants from issuing through the stack.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A fireplace heating unit comprising, a firebox including top, bottom, back and side walls, a housing spaced from and surrounding said firebox, partition means mounted in the space between said firebox and said housing and surrounding said firebox on at least five sides thereby defining an inner air chamber between the firebox and one side of the partition means and an outer air chamber between the opposite side of said partition means and said housing, outside air inlet means connected to said partition means and communicating with said inner air chamber, whereby the incoming outside air is preheated by the firebox, heated air outlet means connected to said inner chamber and communicating with the room to be heated, heated air inlet means connected to said firebox and communicating with said inner air chamber, whereby a portion of the incoming heated outside air is used as combustion air; room air inlet and outlet means connected to the outer chamber, whereby room air is only circulated through said outer chamber, and insulation means mounted on and substantially covering said partition means to thereby maintain the air in the inner chamber at an extremely high temperature, whereby the heat conducted from the firebox walls to the air in the inner chamber, and the insulation means maintaining the heat in the inner chamber causes the combustion air to reach a temperature high enough to ignite the exhaust gases in the firebox to thereby eliminate exhaust smoke.

2. A fireplace heating unit according to claim 1, wherein an exhaust stack is connected to the top wall of the firebox, and glass doors are connected to the front of the firebox, said heated air inlet means connected to said firebox comprising a plurality of apertures provided in the side walls of said firebox in proximity to said doors.

3. A fireplace heating unit according to claim 2, wherein the heated air outlet means communicating with the room to be heated, comprises a louver connected to the housing above the glass doors.

4. A fireplace heating unit according to claim 2, wherein the housing includes top, back and side walls, an enlarged opening provided in the top wall, said stack extending through said enlarged opening, a clearance provided between the edge of the opening and the wall of stack to thereby provide said room air outlet means communicating with said outer chamber, the lower edges of said side walls of said housing being spaced above the floor of the room being heated to thereby provide said room air inlet means communicating with said outer chamber.

5. A fireplace heating unit according to claim 4, wherein brackets are connected between the partition means and the side and back walls of the housing and firebox to maintain the partition means in spaced relationship thereto.

* * * * *